US008434275B2

(12) United States Patent
Hashimoto et al.

(10) Patent No.: US 8,434,275 B2
(45) Date of Patent: May 7, 2013

(54) DOUBLE FLOOR STRUCTURE AND SUPPORT LEG FOR DOUBLE FLOOR STRUCTURE

(75) Inventors: Yakobu Hashimoto, Tokyo (JP); Jun Kondo, Tokyo (JP); Hiroshi Dohi, Tokyo (JP); Mikio Suzuki, Tokyo (JP); Daisuke Chiba, Tokyo (JP); Masahiro Nammoku, Tokyo (JP); Yasutomo Akashi, Tokyo (JP); Kiyofumi Tanaka, Shizuoka (JP); Hideyuki Kaji, Fujisawa (JP); Takeshi Ono, Narashino (JP); Yoshiharu Konishi, Tokyo (JP)

(73) Assignees: Nippon Light Metal Company, Ltd., Tokyo (JP); Nikkeikin Aluminium Core Technology Company Ltd., Tokyo (JP); NTT Facilities, Inc., Tokyo (JP)

( * ) Notice: Subject to any disclaimer, the term of this patent is extended or adjusted under 35 U.S.C. 154(b) by 0 days.

(21) Appl. No.: 13/388,510

(22) PCT Filed: Aug. 3, 2010

(86) PCT No.: PCT/JP2010/063107

§ 371 (c)(1), (2), (4) Date: Feb. 2, 2012

(87) PCT Pub. No.: WO2011/016453

PCT Pub. Date: Feb. 10, 2011

(65) Prior Publication Data

US 2012/0131862 A1 May 31, 2012

(30) Foreign Application Priority Data

Aug. 3, 2009 (JP) ..... 2009-180544

(51) Int. Cl.
*E04B 9/00* (2006.01)

(52) U.S. Cl.
USPC ..... 52/126.6

(58) Field of Classification Search ..... 52/122.1, 52/126.1, 126.5, 126.6, 126.7
See application file for complete search history.

(56) References Cited

U.S. PATENT DOCUMENTS 2,867,301 A * 1/1959 Benton ..... 52/263
2,956,653 A * 10/1960 Liskey, Jr. ..... 52/396.06
3,681,882 A * 8/1972 Bettinger ..... 52/126.6

(Continued)

FOREIGN PATENT DOCUMENTS

JP 2009-150088 7/2009

*Primary Examiner* — Mark Wendell
*Assistant Examiner* — Keith Minter
(74) *Attorney, Agent, or Firm* — Rankin, Hill & Clark LLP

(57) ABSTRACT

A double floor structure capable of being adapted to the conditions of construction and the needs of users at low cost. A double floor structure (K) provided with support legs (1) which are provided on a lower floor and rows of beams which form an upper floor. The support legs (1) are each provided with an upper member (14) which supports a beam from the lower side, an intermediate member (13) which supports the upper member (14) from the lower side, and a lower member (12) which supports the intermediate member (13) from the lower side. The upper member (14), the intermediate member (13), and the lower member (12) consist of metallic, extruded shape material and are disposed in such a manner that the direction of the extrusion is aligned with the top-bottom direction.

15 Claims, 12 Drawing Sheets

U.S. PATENT DOCUMENTS 4,637,181 A * 1/1987 Cohen ..... 52/126.5
7,165,361 B2 * 1/2007 Vanagan ..... 52/126.6
2004/0163338 A1 * 8/2004 Liebendorfer ..... 52/173.1
2005/0284040 A1 * 12/2005 Hashimoto et al. ..... 52/126.1

* cited by examiner

DOUBLE FLOOR STRUCTURE AND SUPPORT LEG FOR DOUBLE FLOOR STRUCTURE

TECHNICAL FIELD

The present invention relates to a double floor structure and a support leg for a double floor structure, where the support leg is used for constructing a double floor.

BACKGROUND ART

Patent Literature 1 discloses a double floor structure in which beams (as constituent members for an upper floor) are arranged on support legs, which are extruded shapes of an aluminum alloy and placed on a lower floor. The support legs disclosed in Patent Literature 1 are formed by assembly of upper, intermediate, and lower members, which are extruded shapes of the aluminum alloy. In the case where a double floor structure is constructed by use of the above support legs, it is possible to comply with various requirements from customers and execution conditions at low cost.

CITATION LIST

Patent Literature

Patent Literature 1: Japanese Patent Laid-open No. 2009-150088

SUMMARY OF INVENTION

Technical Problem

According to the Patent Literature 1, the extrusion direction of the upper member (which supports a beam in the double floor structure) is parallel to the extrusion direction of the beam. On the other hand, the extrusion directions of the intermediate and lower members are the vertical direction, which is perpendicular to the extrusion direction of the upper member. Therefore, the rigidity of the upper member depends on the cross-sectional profile of the extruded shape, so that it is necessary to design the cross-sectional profile of the extruded shape for each of various requirements from customers and execution conditions.

The object of the present invention is to provide a double floor structure and a support leg for a double floor which can comply with various needs of customers and execution conditions at low cost.

Solution to Problem

In order to solve the above problem, according to the present invention, a double floor structure is provided. The double floor structure according to the present invention is a double floor structure having a plurality of support legs to be placed on a lower floor and a plurality of beams which are arranged in a plurality of rows and constitute an upper floor. The double floor structure according to the present invention is characterized in that each of the support legs includes an upper member supporting the beams from a lower side, a lower member arranged below the upper member, and an intermediate member arranged between the upper member and the lower member, and each of the upper member, the intermediate member, and the lower member is formed of a metal extruded shape, and is to be positioned in such a manner that an extrusion direction coincides with the vertical direction.

According to the present invention, the rigidity of the upper members can be varied by changing the cut lengths in which the upper members are cut from a primary extruded shape. Therefore, it is possible to easily adjust the maximum load or the earthquake resistance of the double floor structure. Although it is preferable to form the extruded shapes of one or more aluminum alloys, alternatively, the extruded shapes may be formed of another material as long as extrusion is possible.

In addition, it is preferable to insert an upper portion of the intermediate member into the upper member, and insert a lower portion of the intermediate member into the lower member. In this case, positioning for fixing the upper member to the intermediate member becomes easy, and positioning for fixing the lower member to the intermediate member also becomes easy.

Although there is no limitation on the connection between the upper member and the beams, for example, the upper member and the beams can be connected by use of bolts and nuts. In this case, the upper member may be fixed to the beams by forming one or more latching grooves extending in the length directions of the beams on the lower surfaces of the beams in advance, and screw engaging the one or more shanks of one or more bolts inserted through the upper member with one or more nuts held in the one or more latching grooves or screw engaging the one or more shanks of one or more bolts having one or more heads held in the one or more latching grooves with one or more nuts arranged on the lower side of the upper member. The use of the one or more latching groove enables fixing of each support leg at an arbitrary position in the length direction of each beam, and further enables easy adjustment of the maximum load or earthquake resistance of the double floor structure.

The double floor structure according to the present invention may include one or more connection members which connect adjacent one of the beams. In this case, the support legs supporting one of the adjacent beams are connected to the other of the adjacent beams through the one or more connection members and the adjacent beams, so that the rigidity of the double floor structure can be increased.

It is preferable to use the one or more latching grooves formed on the lower surfaces of the beams for fixing the one or more connection members to the beams. That is, it is preferable to fix the one or more connection members to the beams by screw engaging the shanks of bolts inserted through the one or more connection members with nuts held in the one or more latching grooves or screw engaging the shanks of bolts having heads held in the one or more latching grooves with nuts arranged on the lower sides of the one or more connection members. In this case, the connection member can be fixed at an arbitrary position in the length direction of each beam.

In the case where the double floor structure is formed for placing one or more pieces of equipment, it is preferable to arrange multiple beams under each piece of equipment, and provide seat members realizing seats for each piece of equipment. In this case, it is preferable to form seat-attachment grooves extending in the length directions of the beams on the upper surfaced of the beams in advance, and fix the seat members on the beams by using at least two seat-attachment grooves. When the double floor structure is arranged as above, the seat members can be fixed at arbitrary positions in the length directions on the beams.

In the case where the seat members are arranged between the beams and the equipment, it is preferable to arrange in the seat members a bolt-holding portion for holding the head of an equipment-fixing bolt (which is used for fixing the equipment to the seats) in advance, and form, in the upper wall of the bolt-holding portion, a plurality of equipment-fixing holes or a set of longer and shorter elongated holes through which the shank of the equipment-fixing bolt can be inserted. In this case, it is possible to easily cope with even a situation in which the pitch of bolt-insertion holes formed in each piece of equipment is different.

In the case where the plurality of equipment-fixing holes are formed in the upper wall of the bolt-holding portion, it is preferable to set the positions of the equipment-fixing holes in such a manner that the arrangement of the equipment-fixing holes when the bolt-holding portion is turned around to the opposite direction in the horizontal plane is different from the arrangement of the equipment-fixing holes before the bolt-holding portion is turned around. In this case, the seat members can cope with a greater variety of equipment.

In addition to the seat members, it is preferable to provide supplementary members which transfer the weight of the equipment to the beams. In this case, it is preferable to arrange the supplementary members to straddle the seat members, so that the equipment can be stably supported.

It is possible to arrange covering panels in the areas on which no equipment is placed. In the case where conditioned air for cooling the equipment flows in the underfloor space (i.e., the space between the upper floor and the lower floor) in the double floor structure having the covering panels, dissipation loss of the conditioned air for can be prevented, so that the equipment can be efficiently cooled. It is preferable to detachably arrange the covering panels so as to cover the spaces between adjacent beams. In this case, installation of new equipment on the areas on which no equipment is placed yet is easy.

Further, in order to solve the aforementioned problem, according to the present invention, a support leg to be placed on a lower floor in the double floor structure is provided. The support leg according to the present invention is characterized in that the support leg includes an upper member which supports an upper floor structure constituting an upper floor, a lower member which is arranged below the upper floor, and an intermediate member arranged between the upper member and the lower member, and each of the upper member, the intermediate member, and the lower member is formed of a metal extruded shape, and is to be positioned in such a manner that an extrusion direction coincides with a vertical direction.

The height of the support leg according to the present invention can be varied by merely changing the cut lengths in which each of the upper member, the intermediate member, and the lower member is cut from a primary extruded shape. Therefore, it is possible to easily change the vertical dimension of the underfloor space, and comply with execution conditions and the customers' needs. The constituent members of the upper floor which can be supported by the support leg according to the present invention include planar members such as floor panels as well as the beams. Although the extruded shapes are preferably formed of aluminum alloys, the extruded shapes may be formed of other metals as long as extrusion is possible.

Although there is no limitation on the cross-sectional profile of the intermediate member, it is preferable that the intermediate member have a cylindrical shape. When conditioned air for cooling the equipment flows in the underfloor space, the intermediate member having a cylindrical shape makes the flow of the conditioned air smooth, so that the equipment is efficiently cooled. In addition, the intermediate member having a cylindrical shape does not have any protrusion or the like on the peripheral surface (i.e., the peripheral surface of the intermediate member has a shape conformable to cables). Therefore, the underfloor cables are less likely to be damaged, and wiring operations can be performed smoothly. Further, since the profile of the intermediate member is directionally uniform, the manufacturing error can be easily absorbed.

Although there is no limitation on the manner of connecting the upper member, the intermediate member, and the lower member, it is preferable to join, by welding, the upper member and the intermediate member, and the intermediate member and the lower member. Although bolt connection needs drilling of parts, tightening of bolts, and other work, such work can be dispensed with by use of the welding.

It is preferable to form a female screw in the side wall of the intermediate member. In this case, optional parts (for example, cable trays, jigs, and the like for fixing wiring and piping) can be easily fixed.

Effect of Invention

The double floor structure and the support leg for the double floor structure according to the present invention make it possible to comply with execution conditions and the customers' needs.

DESCRIPTION OF EMBODIMENTS

Figure 1:
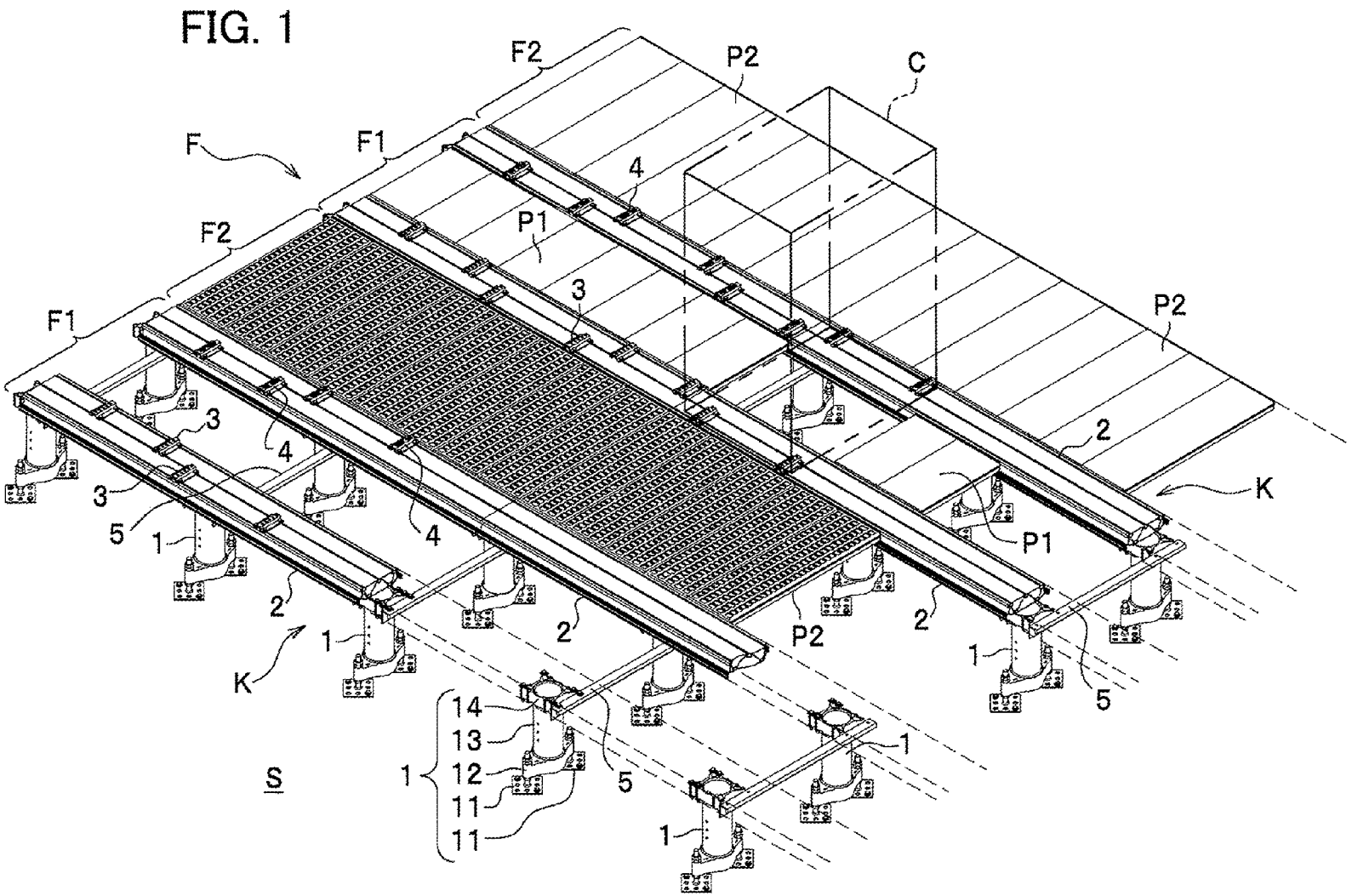
FIG. 1 is a perspective view illustrating a double floor including a double floor structure according to an embodiment of the present invention.

The double floor F illustrated in FIG. 1 is constructed on the lower floor (floor slabs) S, for example, in a data center. The double floor F includes equipment-installation areas F1 and passage areas F2. The pieces of equipment C are placed on the equipment-installation areas F1, and the passage areas F2 are arranged adjacent to the equipment-installation areas F1. There is no limitation on the type and size of the pieces of equipment C and the standards with which the pieces of equipment C are required to comply. The pieces of equipment C include not only apparatuses and instruments, and also containers and racks for the apparatuses and instruments.

The equipment-installation areas F1 are formed with double floor structures K according to the present embodiment. The passage areas F2 are formed with multiple floor panels P1, P2, . . . arranged between adjacent ones of the double floor structures K. One or more covering panels P are arranged over the areas on which no equipment is placed (uninstalled areas) even in the equipment-installation areas F1. Conditioned air flows in the underfloor space, and blows upward to cool the pieces of equipment C.

Each double floor structure K includes a plurality of support legs 1, beams 2 in two rows, first seat members 3, second seat members 4, and connection members 5. The support legs 1 are arranged on the lower floor S. The beams 2 in two rows constitute an upper floor. The first seat members 3 and the second seat members 4 realize one or more seats for the pieces of equipment C. The connection members 5 indirectly connect the beams 2 in two rows. In the following explanations, the expressions "front" and "front and rear" are used with respect to the length direction of each of the beams 2. For example, the front-rear direction is the length direction of each of the beams 2.

First, the structure of each of the support legs 1 is explained in detail.

Figure 3:
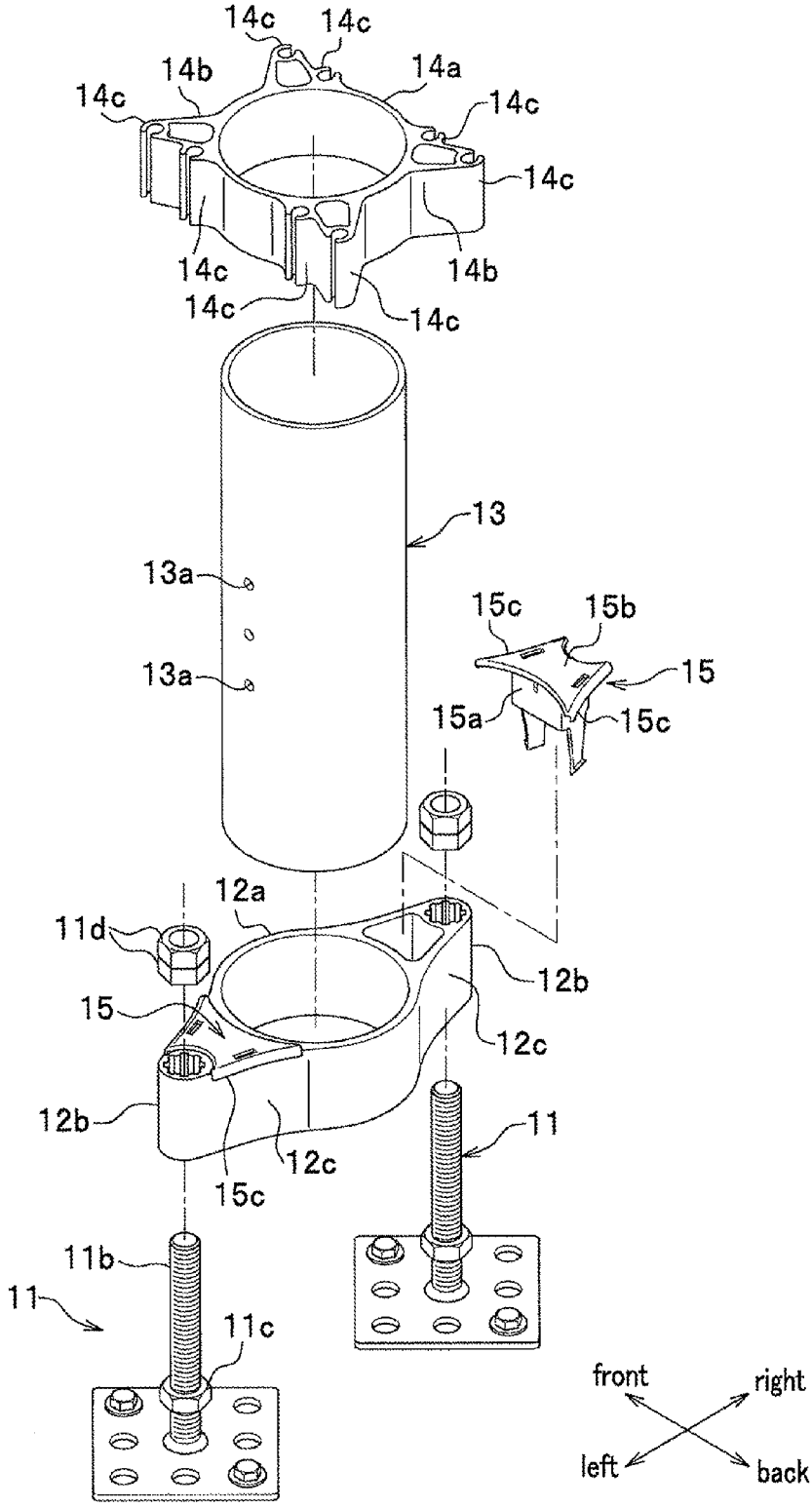
FIG. 3 is an exploded perspective view of the support leg according to the embodiment of the present invention.

Each of the support legs 1 includes a pair of legs 11, a lower member 12, an intermediate member 13, an upper member 14, and protection covers 15, as illustrated in FIG. 3. The pair of legs 11 are arranged to stand on the lower floor S. The lower member 12 is arranged between the pair of legs 11. The intermediate member 13 is supported by the lower member 12. The upper member 14 is supported by the intermediate member 13. The protection covers 15 are attached to the lower member 12 (as illustrated in FIG. 3).

Figure 2:
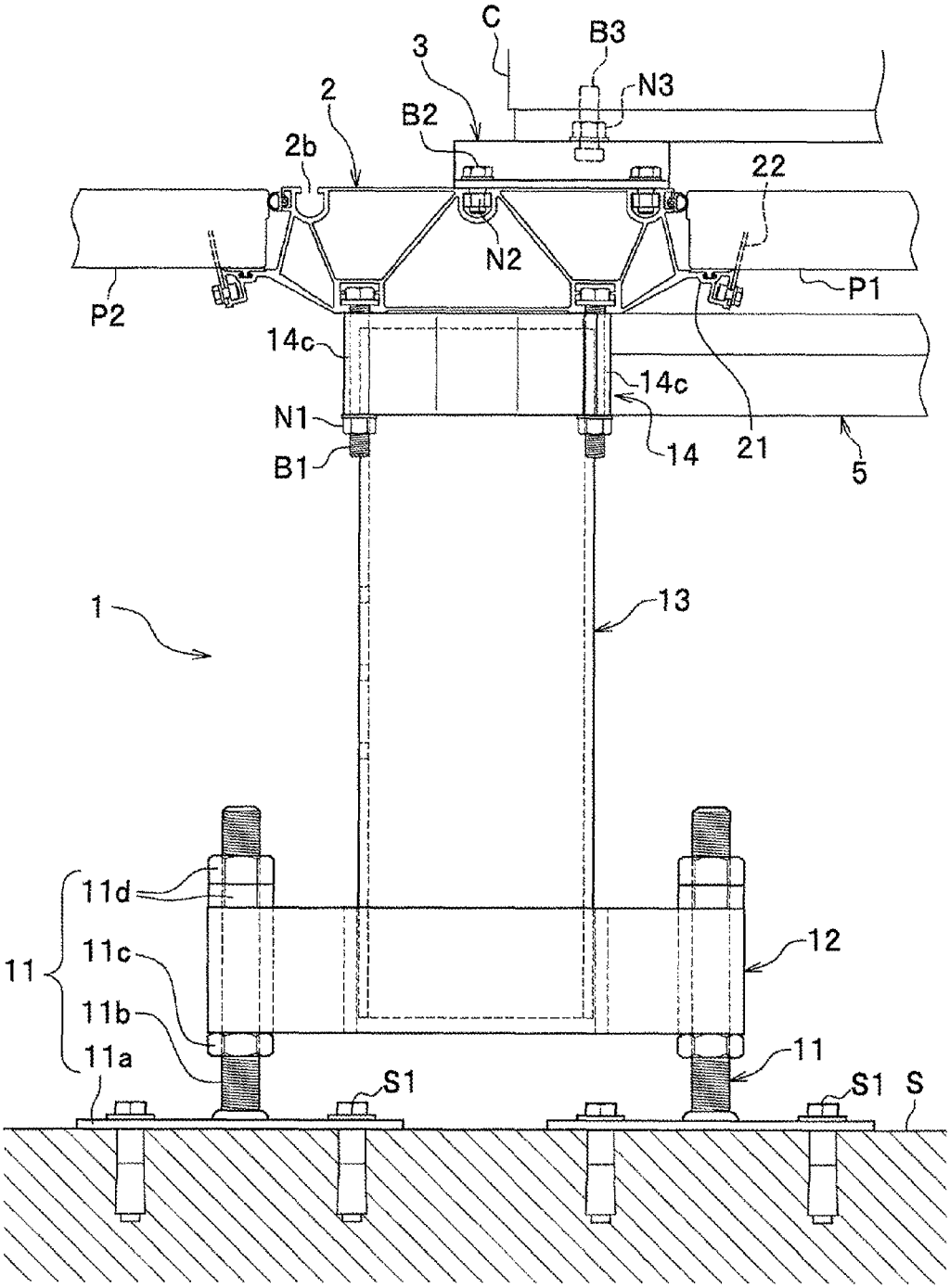
FIG. 2 is a front view of a support leg according to the embodiment of the present invention.

As illustrated in FIG. 2, each of the legs 11 includes a base plate 11*a*, a column portion 11*b*, a lower nut 11*c*, and an upper nut 11*d*. The base plate 11*a* is fixed onto the lower floor S. The column portion 11*b* is arranged to stand on the base plate 11*a*. The lower nut 11*c* and the upper nut 11*d* are screw engaged with male screws on the column portion 11*b* in such a manner that the lower nut 11*c* and the upper nut 11*d* sandwich the lower member 12. The base plate 11*a* is fixed to the upper surface of the lower floor S with anchor bolts S1, which are buried in the lower floor S from the upper side of the lower floor S.

Figure 4A:
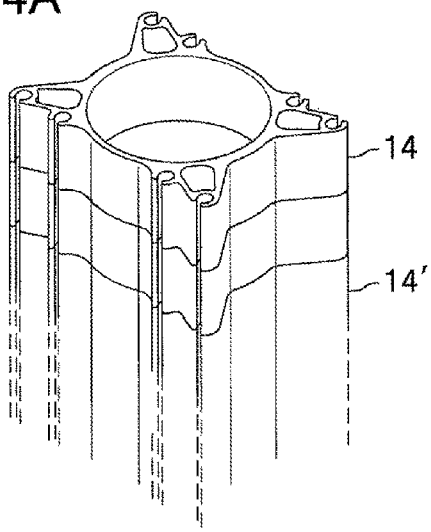
FIG. 4A is a perspective view illustrating a method for production of an upper member of members constituting the support leg.
Figure 4B:
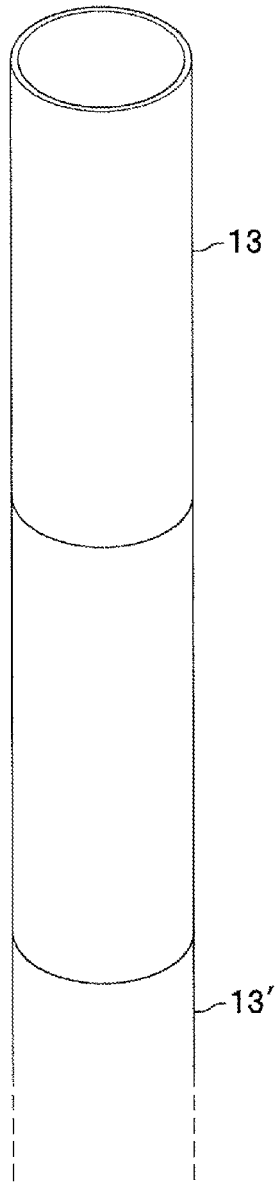
FIG. 4B is a perspective view illustrating a method for production of an intermediate member of the members constituting the support leg.
Figure 4C:
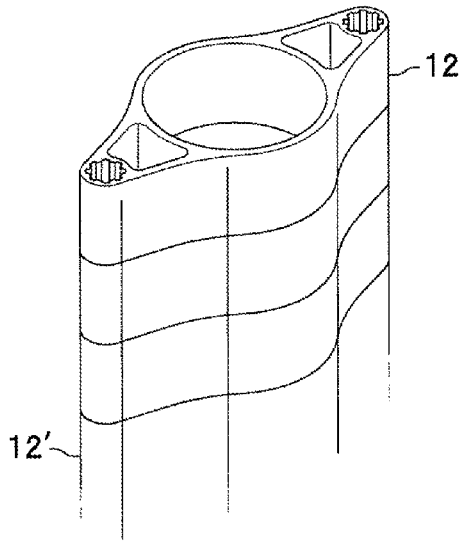
FIG. 4C is a perspective view illustrating a method for production of a lower member of the members constituting the support leg.

The lower member 12 is a member for supporting the intermediate member 13 from the lower side, and is arranged below the upper member 14. The lower member 12 is supported by the legs 11 in such a manner that the lower member 12 is raised above the lower floor S. As illustrated in FIG. 3, the lower member 12 is realized by an extruded shape of an aluminum alloy having a hollow cross section, and is positioned in such a manner that the extrusion direction coincides with the vertical direction. In other words, the lower member 12 is arranged so that hollows formed in a primary extruded shape from which the lower member 12 is cut continuously extend in the vertical direction in the lower member 12 and produces openings on the upper and lower sides of the lower member 12. As illustrated in FIG. 4C, the lower member 12 can be produced by cutting the primary extruded shape 12' having the same cross section as the lower member 12 along a plane perpendicular to the extrusion direction (i.e., the horizontal plane in FIG. 4C).

As illustrated in FIG. 3, the lower member 12 in the present embodiment includes a frame portion 12*a*, leg-connection portions 12*b*, and ribs 12*c*. The intermediate member 13 is connected to the frame portion 12*a*. The leg-connection portions 12*b* are respectively connected to the legs 11. The leg-connection portions 12*b* are respectively connected to the frame portion 12*a* through the ribs 12*c*, respectively.

The frame portion 12*a* has a shape corresponding to the intermediate member 13. Since the intermediate member 13 has a cylindrical shape in the present embodiment, the frame portion 12*a* also has a cylindrical shape corresponding to the intermediate member 13. The bottom portion of the intermediate member 13 is inserted into the hollow of the frame portion 12*a*. The inner diameter of the frame portion 12*a* is slightly greater than the outer diameter of the intermediate member 13.

The leg-connection portions 12*b* are arranged on both sides of the frame portion 12*a*. Although there is no limitation on the shapes of the leg-connection portions 12*b*, the leg-connection portions 12*b* in the present embodiment each have a tubular shape. The column portions 11*b* of the pair of legs 11 are respectively inserted through the hollows in the leg-connection portions 12*b*. The hollows (holes) in the leg-connection portions 12*b* may be formed when the primary extruded shape 12' (from which the lower member 12 is cut as illustrated in FIG. 4C) is produced by extrusion, or may be formed by drilling after extrusion. The leg-connection portions 12*b* need not have a closed cross section, and may have an open cross section (e.g., a C-shaped cross section) as long as the column portions 11*b* can be inserted through the leg-connection portions 12*b*.

The ribs 12*c* are laterally projected from the frame portion 12*a*. In each of the ribs 12*c* in the present embodiment, a hollow continuously extending in the vertical direction is formed.

The lower member 12 is fixed to the pair of legs 11 as follows. First, the lower nut 11*c* is screw engaged with the column portion 11*b* in each of the pair of legs 11. Then, the column portions 11*b* are inserted through the leg-connection portions 12*b* of the lower member 12 so that the leg-connection portions 12*b* are placed on the lower nuts 11*c*. Thereafter, the upper nuts 11*d* are screwed onto the column portions 11*b* (as illustrated in FIG. 2) and tightened. Since the elevation of the lower member 12 can be finely adjusted by controlling the positions of the lower nuts 11*c* and the upper nuts 11*d*, it is possible to easily cope with unevenness, inclination, or the like of the finished surface of the lower floor S.

As illustrated in FIG. 2, the intermediate member 13 is a member for supporting the upper member 14 from the lower side, and is arranged between the lower member 12 and the upper member 14. As illustrated in FIG. 3, the intermediate member 13 is formed of an extruded shape of an aluminum alloy having a hollow cross section, and is positioned in such a manner that the extrusion direction coincides with the vertical direction. In other words, the intermediate member 13 is arranged so that hollows formed in a primary extruded shape from which the intermediate member 13 is cut produces openings on the upper and lower sides of the intermediate member 13. As illustrated in FIG. 4B, the intermediate member 13 can be produced by cutting the primary extruded shape 13' having the same cross section as the intermediate member 13 along a plane perpendicular to the extrusion direction (i.e., the horizontal plane in FIG. 4B).

The intermediate member 13 has a cylindrical shape. As illustrated in FIG. 13, female screws 13*a* are formed on the side wall of the intermediate member 13. Although not shown, male-screwed parts for fixing optional parts (for example, cable trays, jigs, and the like for fixing wiring and piping) are screw engaged with the female screws.

Figure 5:
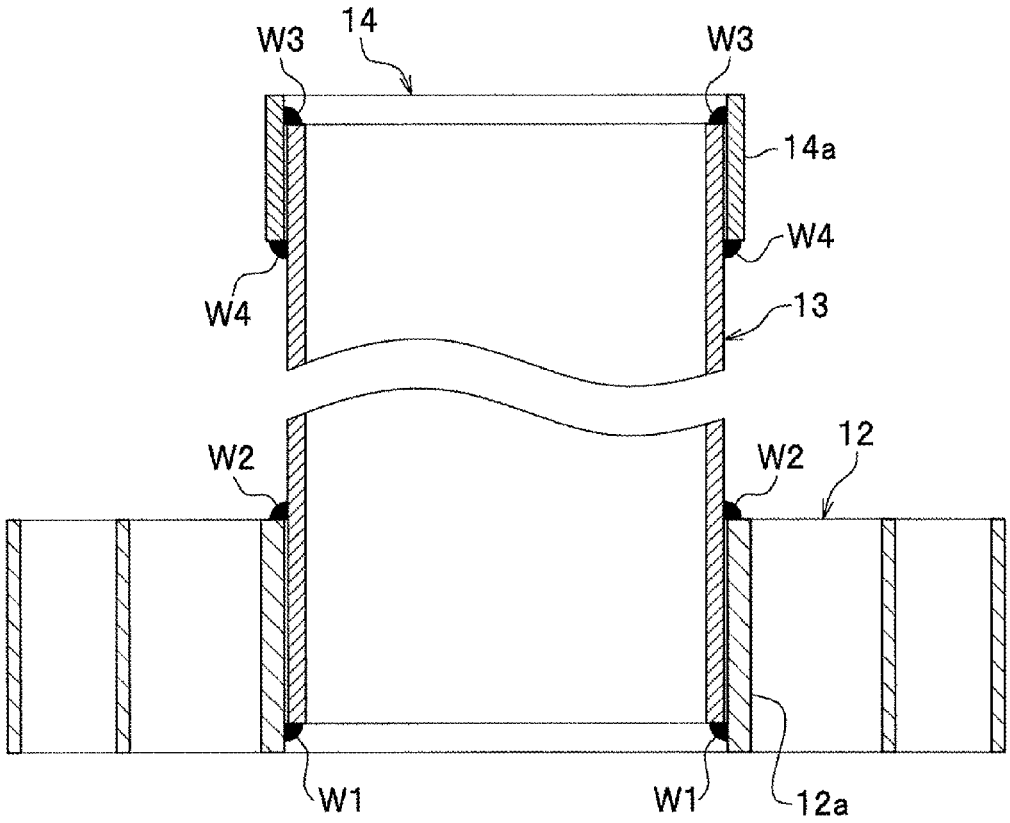
FIG. 5 is a cross-sectional view of the support leg according to the embodiment of the present invention.

The intermediate member 13 and the lower member 12 can be joined by welding after the bottom portion of the intermediate member 13 is inserted into the frame portion 12*a* in the lower member 12 as illustrated in FIG. 5. In the present embodiment, the bottom face of the intermediate member 13 is maintained above the bottom face of the frame portion 12*a*, and the bottom face of the intermediate member 13 is welded to the inner surface of the frame portion 12*a* in the entire circle (as indicated by the reference W1). In addition, the top face of the frame portion 12*a* is welded to the outer surface of the intermediate member 13 in the entire circle (as indicated by the reference W2). Although the lower member 12 and the intermediate member 13 are joined by welding at the upper and lower positions (indicated by the references W1 and W2) in the illustrated example, alternatively, the lower member 12 and the intermediate member 13 may be joined by welding at only one of the upper and lower positions. Further, although the entire circle is welded in the illustrated example, the weld may be performed intermittently.

As illustrated in FIG. 2, the upper member 14 is a member for supporting one of the beams 2 from the lower side, and is arranged between the intermediate member 13 and the beam 2. As illustrated in FIG. 3, the upper member 14 is formed of an extruded shape of an aluminum alloy having a hollow cross section, and is positioned in such a manner that the extrusion direction coincides with the vertical direction. In other words, the upper member 14 is arranged so that hollows formed in a primary extruded shape from which the upper member 14 is cut produces openings on the upper and lower sides of the upper member 14. As illustrated in FIG. 4A, the upper member 14 can be produced by cutting the primary extruded shape 14' having the same cross section as the upper member 14 along a plane perpendicular to the extrusion direction (i.e., the horizontal plane in FIG. 4A).

As illustrated in FIG. 3, the upper member 14 in the present embodiment includes a frame portion 14*a*, projecting portions 14*b*, and insert-receiving portions 14*c*. The intermediate member 13 is connected to the frame portion 14*a*. The projecting portions 14*b* radially project from the frame portion 14*a*. The insert-receiving portions 14*c* are respectively arranged around the frame portion 14*a*.

The frame portion 14*a* has a shape corresponding to the intermediate member 13. The frame portion 14*a* also has a cylindrical shape corresponding to the intermediate member 14. The top portion of the intermediate member 13 is inserted into the hollow of the frame portion 14*a*. The inner diameter of the frame portion 14*a* is slightly greater than the outer diameter of the intermediate member 13.

The projecting portions 14*b* are formed on the periphery of the frame portion 14*a*, Hollows continuously extending in the vertical direction are formed in the projecting portions 14*b*.

The insert-receiving portions 14*c* are portions for guiding the shanks of beam-fixing bolts B1 (as illustrated in FIG. 2), and respectively have hollows continuously extending in the vertical direction. In the present embodiment, four insert-receiving portions 14*c* are arranged on each of the left and right sides of the frame portion 14*a*. Part of the insert-receiving portions 14*c* arranged on the right side are aligned along a straight line, and part of the insert-receiving portions 14*c* arranged on the left side are also aligned along a straight line. Each of the insert-receiving portions 14*c* in the present embodiment has a C-shaped cross section, and a slit continuously extending in the vertical direction is formed in the side surface of each of the insert-receiving portions 14*c*. The insert-receiving portions 14*c* is designed to have an open cross section in order to facilitate manufacture of the primary extruded shape 14' (from which the upper member 14 is cut as illustrated in FIG. 4A). However, the insert-receiving portions 14*c* need not have an open cross section, and may have a closed cross section as long as the shanks of the bolts can be inserted through the insert-receiving portions 14*c*. The insert-receiving portions 14*c* may be formed when the primary extruded shape 14' (from which the upper member 14 is cut as illustrated in FIG. 4A) is produced by extrusion, or may be formed by drilling after extrusion.

The upper member 14 and the lower member 12 can be joined by welding after the top portion of the intermediate member 13 is inserted into the frame portion 14*a* in the upper member 14 as illustrated in FIG. 5. In the present embodiment, the top face of the intermediate member 13 is maintained below the top face of the frame portion 14*a*, and the top face of the intermediate member 13 is welded to the inner surface of the frame portion 14*a* in the entire circle (as indicated by the reference W3). In addition, the bottom face of the frame portion 14*a* is welded to the outer surface of the intermediate member 13 in the entire circle (as indicated by the reference W4). Although the upper member 14 and the intermediate member 13 are joined by welding at the upper and lower positions (indicated by the references W3 and W4) in the illustrated example, alternatively, the upper member 14 and the intermediate member 13 may be joined by welding at only one of the upper and lower positions. Further, although the entire circle is welded in the illustrated example, the weld may be performed intermittently.

The protection covers 15 illustrated in FIG. 3 covers at least a portion of the edges of the lower member 12, and is formed of synthetic resin. Each of the protection covers 15 in the present embodiment includes an insertion portion 15*a*, a cover portion 15*b*, and edge-cover portions 15*c*. The insertion portion 15*a* is inserted into the hollow in each of the ribs 12*c*. The cover portion 15*b* covers the upper surface of each of the ribs 12*c*. The edge-cover portions 15*c* cover the edges of each of the ribs 12*c*. The edge-cover portions 15*c* are formed to have a round-shaped upper surface. Since the lower member 12 is formed by cutting from a primary extruded shape, the ribs 12*c* are likely to have sharp edges. However, the edge-cover portions 15*c* covering the edges can prevent contact of the wiring (not shown) with the edges. Therefore, it is possible to prevent damaging to wiring by the edges. Further, in the case where the edges of the lower member 12 are chamfered, or in the case where a countermeasure against the damaging to the wiring is taken, the protection cover 15 may be dispensed with, although the cost of the provision of the protection cover 15 is lower than the cost of the chamfering of the edges of the lower member 12.

Next, the structure of the beams 2 is explained in detail.

As illustrated in FIG. 1, the beams 2 are a kind of constituent members of the upper floor. In the present embodiment, the beams 2 constitute a part of the floor face in the equipment-installation areas F1, and support the covering panels P1 (arranged over the uninstalled areas) and floor panels P2 (constituting the floor face in the passage areas F2).

Each of the beams 2 is arranged over ones (three in the present embodiment) of the support legs 1, which are arranged at intervals. The beams 2 in the present embodiment are formed of an extruded shape of an aluminum alloy having a hollow cross section.

Figure 6:
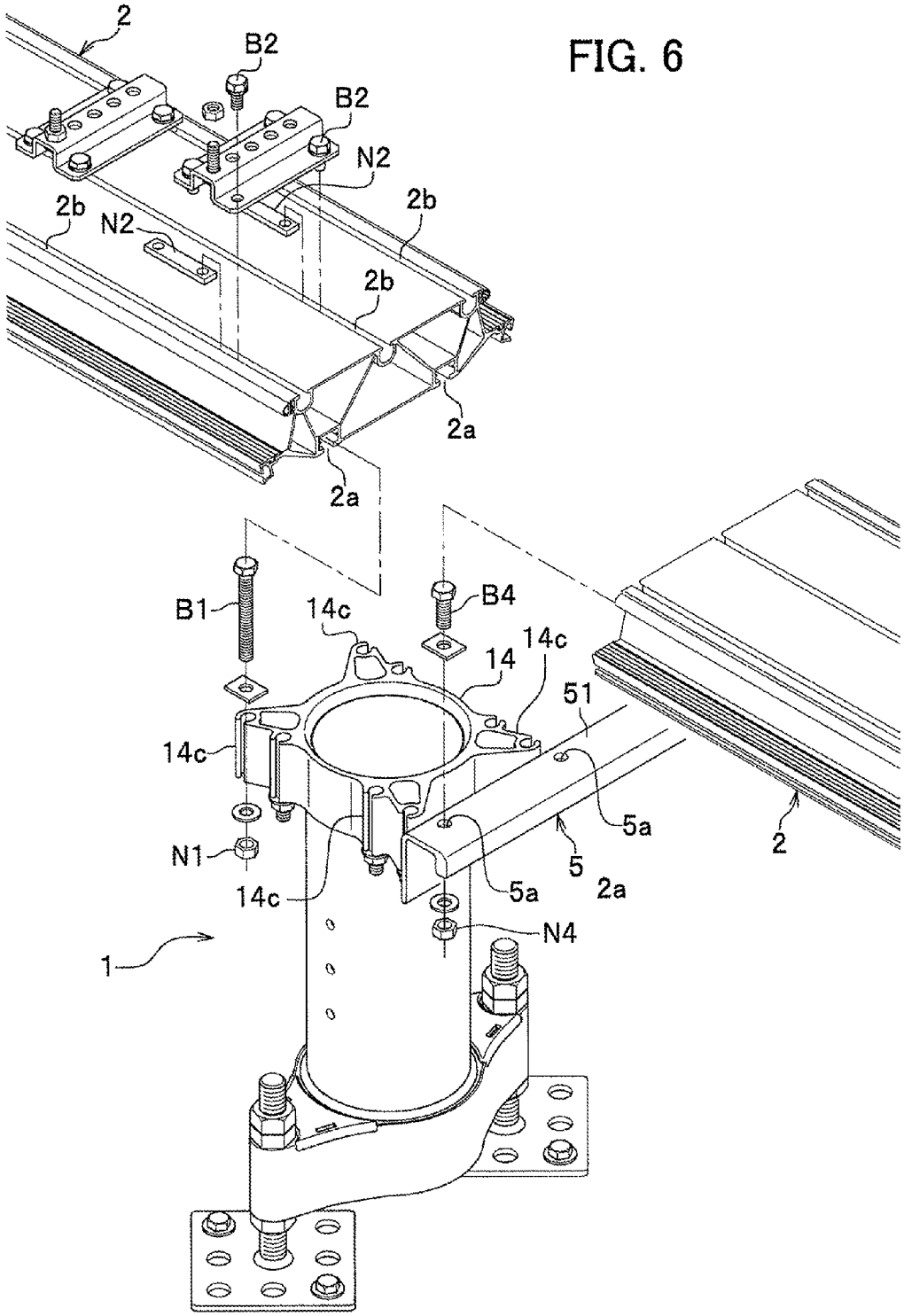
FIG. 6 is a partially-exploded perspective view of the double floor structure according to the embodiment of the present invention.

As illustrated in FIG. 6, in each of the beams 2, multiple rows (two rows in the present embodiment) of latching grooves 2*a* extending in the length direction (in the extrusion direction) of the beam 2 are arranged on the lower surface of the beam 2, and multiple rows (three rows in the present embodiment) of seat-attachment grooves 2*b* extending in the length direction (in the extrusion direction) of the beam 2 are arranged on the upper surface of the beam 2.

The heads of the beam-fixing bolts B1 are held in the latching grooves 2*a*. The opening widths of the latching grooves 2*a* are arranged to be smaller than the widths across flats (i.e., the minimum widths) of the beam-fixing bolts B1 so that the heads of the beam-fixing bolts B1 held in the latching grooves 2*a* do not fall off the latching grooves 2*a*. The one of the latching grooves 2*a* on the right side is formed at the position corresponding to the four insert-receiving portions 14*c* aligned on the right side, and the one of the latching grooves 2*a* on the left side is formed at the position corresponding to the four insert-receiving portions 14*c* aligned on the left side.

Female-screw members N2 for fixing the seats are held in the seat-attachment grooves 2*b*. The opening widths of the seat-attachment grooves 2*b* are arranged to be smaller than the widths of the female-screw members N2 so that the female-screw members N2 held in the seat-attachment grooves 2*b* do not fall off the seat-attachment grooves 2*b*.

Each of the beams 2 can be fixed to the support legs 1 by placing the beam 2 on the upper members 14 of the support legs 1, and joining the upper member 14 to the beam 2 by using the beam-fixing bolts B1 and beam-fixing nuts N1. Specifically, the beam 2 can be fixed to the support legs 1 by inserting the heads of the beam-fixing bolts B1 into the latching grooves 2*a* from an end of the beam 2, inserting the shanks of the beam-fixing bolts B1 into the insert-receiving portions 14*c* from the upper side, screwing the beam-fixing nuts N1 onto portions of the shanks of the beam-fixing bolts B1 which protrude from the lower ends of the insert-receiving portions 14*c*, and tightening the beam-fixing nuts N1 (as illustrated in FIG. 2). It is possible to appropriately select ones of the insert-receiving portions 14*c* for use, for example, according to the strengths of the beam-fixing bolts B1 and the position at which each of the support legs 1 is placed. For example, it is preferable to use all the four insert-receiving portions 14*c* on each of the left and right sides of each upper member 14 located at the ends of the beam 2, and use two of the four insert-receiving portions 14*c* on each of the left and right sides of each upper member 14 located at the center of the beam 2. Although not shown, alternatively, each of the beams 2 can be fixed to the support legs 1 by inserting the shanks of the beam-fixing bolts B1 into the insert-receiving portions 14*c* from the lower side of the upper members 14, and screw engaging the beam-fixing bolts B1 with the beam-fixing nuts N1 held in the latching grooves 2*a*.

Next, the structures of the first seat members 3 and the second seat members 4 illustrated in FIG. 1 are explained. The first seat members 3 and the second seat members 4 are members realizing the seats for the pieces of equipment C. The first seat members 3 are arranged on a first one of the beams 2, and the second seat members 4 are arranged on a second one of the beams 2.

Figure 7A:
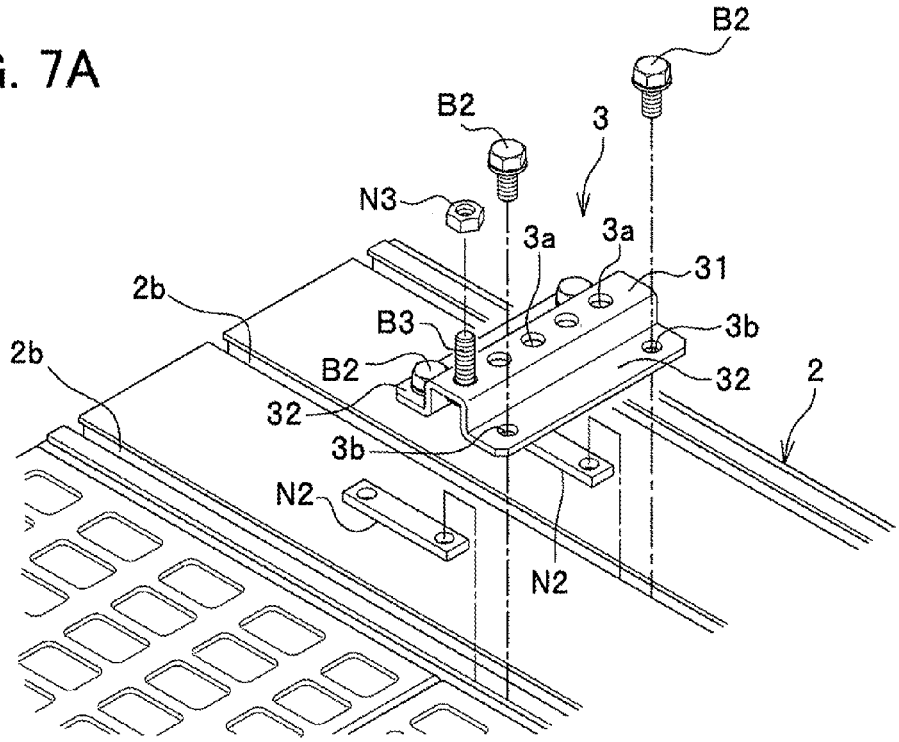
FIG. 7A is a perspective view of a first seat member.

As illustrated in FIG. 7A, the first seat members 3 are arranged to straddle the two seat-attachment grooves 2*b* which are adjacent to each other in the lateral direction, and the first seat members 3 are fixed to the upper surface of the first one of the beams 2 by using the two seat-attachment grooves 2*b*. Each of the first seat members 3 is constituted by a bolt holder 31 and flanges 32. The bolt holder 31 holds the head of an equipment-fixing bolt B3. The flanges 32 are formed on the front and rear sides of the bolt holder 31. A plurality of equipment-attachment holes 3*a* being arrayed in the direction perpendicular to the seat-attachment grooves 2*b* are arranged in the upper wall of the bolt holder 31. The shank of the equipment-fixing bolt B3 can be inserted through the equipment-attachment holes 3*a*. In addition, a pair of through holes 3*b* spaced by the distance between the two adjacent seat-attachment grooves 2*b* are formed in each of the flanges 32. The shanks of seat-fixing bolts B2 are inserted into the through holes 3*b*. The first seat members 3 in the present embodiment are formed of a steel plate which is press molded to a convex shape. (The steel may include stainless steel.) Alternatively, the first seat members 3 may be formed of an extruded shape of an aluminum alloy.

Figure 7B:
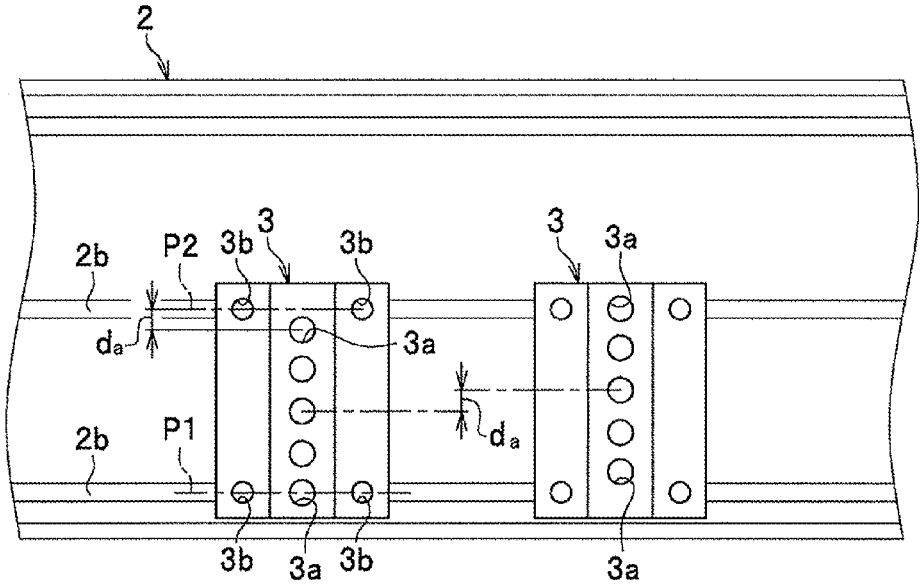
FIG. 7B is a top view of the first seat member.

As illustrated in FIG. 7B, the equipment-attachment holes 3*a* in each first seat members 3 are formed in an arrangement asymmetric in the lateral (left-right) direction. The positions of the equipment-fixing holes 3*a* are set in such a manner that the arrangement of the equipment-fixing holes 3*a* after the first seat members 3 is turned 180 degrees around in the horizontal plane is different from the arrangement of the equipment-fixing holes 3*a* before the first seat members 3 is turned 180 degrees around in the horizontal plane. In the present embodiment, the center of one of the equipment-fixing holes 3*a* at an end of the array of the equipment-fixing holes 3*a* is located on a reference line P1, and the center of one of the equipment-fixing holes 3*a* at the other end of the array of the equipment-fixing holes 3*a* is located offset from a reference line P2 (toward the reference line P1). The offset amount $d_a$ from the reference line P2 is equal to half of the distance between the centers of the adjacent ones of the equipment-fixing holes 3*a*. When each of the first seat members 3 having the above arrangement of the equipment-fixing holes 3*a* is turned 180 degrees around in the horizontal plane, the positions of the equipment-fixing holes 3*a* are shifted by the offset amount $d_a$ from the positions of the equipment-fixing holes 3*a* before the 180-degree turn around. Therefore, even in the case where the positions of bolt-insertion holes formed in a piece of equipment C do not fit the positions of the equipment-fixing holes 3*a*, it is possible to easily cope with such a case by turning around the first seat members 3 to the opposite direction. The reference line P1 is a straight line passing through the centers of the through holes 3*b* which are arranged along one of the two seat-attachment grooves 2*b*, and the reference line P2 is a straight line passing through the centers of the through holes 3*b* which are arranged along the other of the two seat-attachment grooves 2*b*. In FIG. 7B, the seat-fixing bolts B2 are not illustrated.

The first seat members 3 can be fixed to the beam 2 by selecting two of the three seat-attachment grooves 2*b*, placing the first seat members 3 on the beam 2, inserting the shanks of the seat-fixing bolts B2 through the through holes 3*b* from the upper side of the first seat members 3, and screw engaging the shanks of the seat-fixing bolts B2 with the female-screw members N2 held in the seat-attachment grooves 2*b*. Alternatively, although not shown, it is possible to hold the heads of the seat-fixing bolts B2 in the seat-attachment grooves 2*b*, and screw engage the shanks of the seat-fixing bolts B2 protruding from the seat-attachment grooves 2*b*, with nuts arranged on the upper side of the flanges 32. The positions at which the first seat members 3 are attached can be moved in the front-rear direction by moving the positions at which the seat-fixing bolts B2 are screw engaged with the female-screw members N2, along the direction in which the seat-attachment grooves 2*b* extend. Further, the position at which each of the first seat members 3 is attached can be moved in the lateral direction by changing the seat-attachment groove to which the first seat member 3 is attached.

As illustrated in FIG. 2, each piece of equipment C can be fixed to ones of the first seat members 3 by placing the piece of equipment C on the upper surface of the first seat members 3 and joining the piece of equipment C to the first seat members 3 by use of the equipment-fixing bolt B3 and equipment-fixing nuts N3.

Figure 8A:
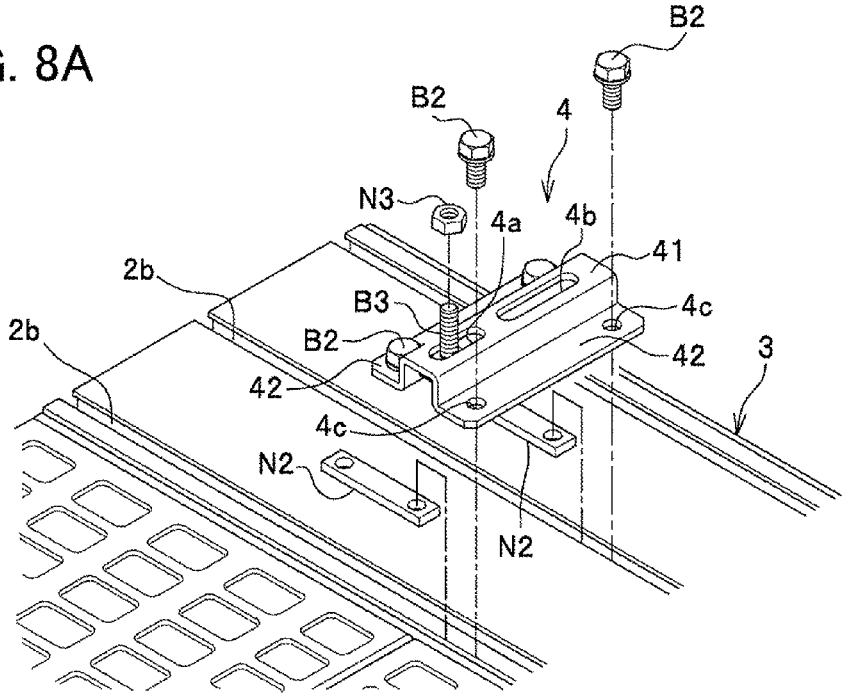
FIG. 8A is a perspective view of a second seat member.

As illustrated in FIG. 8A, the second seat members 4 are arranged to straddle the two seat-attachment grooves 2*b* which are adjacent to each other in the lateral direction of the second one of the beams 2, and fixed to the upper surface of the beam 2 by use of the seat-attachment grooves 2*b*. Each of the second seat members 4 is constituted by a bolt holder 41 and flanges 42. The bolt holder 41 holds the head of an equipment-fixing bolt B3. The flanges 42 are formed on the front and rear sides of the bolt holder 41. A shorter elongated hole 4*a* and a longer elongated hole 4*b*, which are elongated in the direction perpendicular to the seat-attachment grooves 2*b*, are arranged in the upper wall of the bolt holder 41. The shank of the equipment-fixing bolt B3 can be inserted through the elongated hole 4*a* or 4*b*. In addition, a pair of through holes 4*b* spaced by the distance between the two adjacent seat-attachment grooves 2*b* are formed in each of the flanges 42. The shanks of the seat-fixing bolts B2 are inserted into the through holes 4*b*. The second seat members 4 in the present embodiment are formed of a steel plate which is press molded to a convex shape. (The steel may include stainless steel.) Alternatively, the second seat members 4 may be formed of an extruded shape of an aluminum alloy.

Figure 8B:
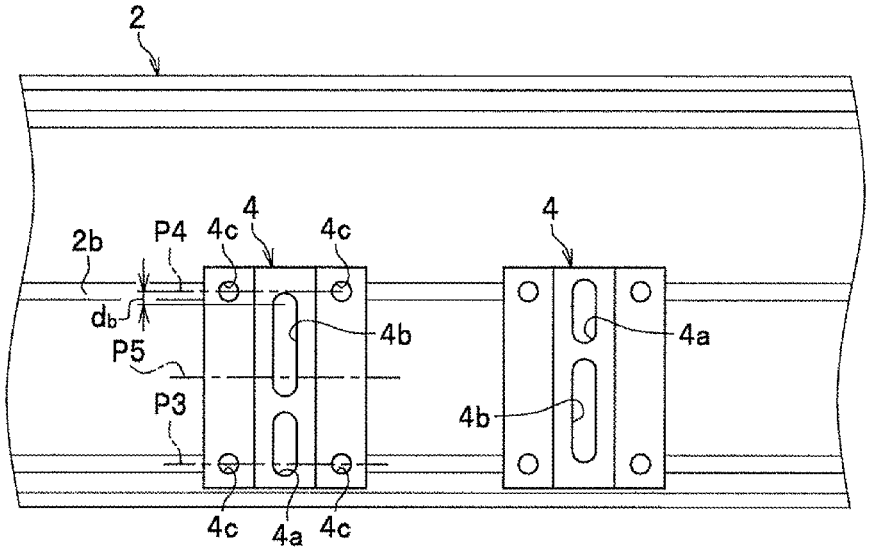
FIG. 8B is a top view of the second seat member.

As illustrated in FIG. 8B, the (shorter) elongated hole 4*a* is elongated toward another reference line P4 from a position at which the elongated hole 4*a* intersects with a reference line P3. The (longer) elongated hole 4*b* is elongated toward the reference line P4 from a position at which the elongated hole 4*b* intersects with a center line P5 extending in the center of the width of the second seat members 4. The end of the elongated hole 4*a* on the reference line P3 side is shaped into a semicircular shape. The central position of the semicircular portion of the shorter elongated hole 4*a* is located on the reference line P3. The end of the elongated hole 4*b* on the reference line P4 side is shaped into a semicircular shape. The central position of the semicircular portion of the shorter elongated hole 4*b* is located offset from the reference line P4 toward the reference line P3. The offset amount $d_b$ from the reference line P4 is equal to the radius of the semicircular portion of the elongated hole 4*b*. That is, the elongated hole 4*b* is formed not to intersect with the reference line P4. When the second seat members 4 having the above arrangement of the elongated holes 4*a* and 4*b* is turned 180 degrees around in the horizontal plane, the positional relationship between the shorter elongated holes 4*a* and 4*b* is inverted as illustrated on the right side in FIG. 8B, and the position of the end of the shorter elongated hole 4*a* after the 180-degree turn around is offset by the offset amount $d_b$ from the position of the end of the elongated hole 4*b* before the 180-degree turn around. Therefore, it is possible to adjust the position at which insertion of the equipment-fixing bolt B3 is allowed. Thus, even in the case where the positions of bolt-insertion holes formed in a piece of equipment C do not fit the positions of the elongated holes 4*a* and 4*b*, it is possible to easily cope with such a case by turning around the second seat members 4 to the opposite direction. The reference line P3 is a straight line passing through the centers of the through holes 4*c* which are arranged along one of the two seat-attachment grooves 2*b*, and the reference line P2 is a straight line passing through the centers of the through holes 4*c* which are arranged along the other of the two seat-attachment grooves 2*b*. In FIG. 8B, the seat-fixing bolts B2 are not illustrated.

The second seat members 4 can be fixed to the beam 2 by selecting two of the three seat-attachment grooves 2*b*, placing the second seat members 4 on the beam 2, inserting the shanks of the seat-fixing bolts B2 through the through holes 4*c* from the upper side of the second seat members 4, and screw engaging the shanks of the seat-fixing bolts B2 with the female-screw members N2 held in the seat-attachment grooves 2*b*. Alternatively, although not shown, it is possible to hold the heads of the seat-fixing bolts B2 in the seat-fixing grooves 2*b*, and screw engage the shanks of the seat-fixing bolts B2 protruding from the seat-fixing grooves 2*b*, with nuts arranged on the upper side of the flanges 42. The positions at which the second seat members 4 are attached can be moved in the front-rear direction by moving the positions at which the seat-fixing bolts B2 are screw engaged with the female-screw members N2, along the direction in which the seat-attachment grooves 2*b* extend. Further, the position at which each of the second seat members 4 is attached can be moved in the lateral direction by changing the seat-attachment groove to which the second seat member 4 is attached.

Female screws in the number corresponding to the number of the seat-fixing bolts B2 inserted through the seat-attachment grooves 2*b* (two in the present embodiment) are formed in each of the female-screw members N2. In this case, the first and second seat members 3 and 4 can be attached to the beams 2 simply and quickly.

The pieces of equipment C (illustrated in FIG. 1) can also be fixed to ones of the second seat members 4 in a similar manner to the first seat members 3.

Figure 9:
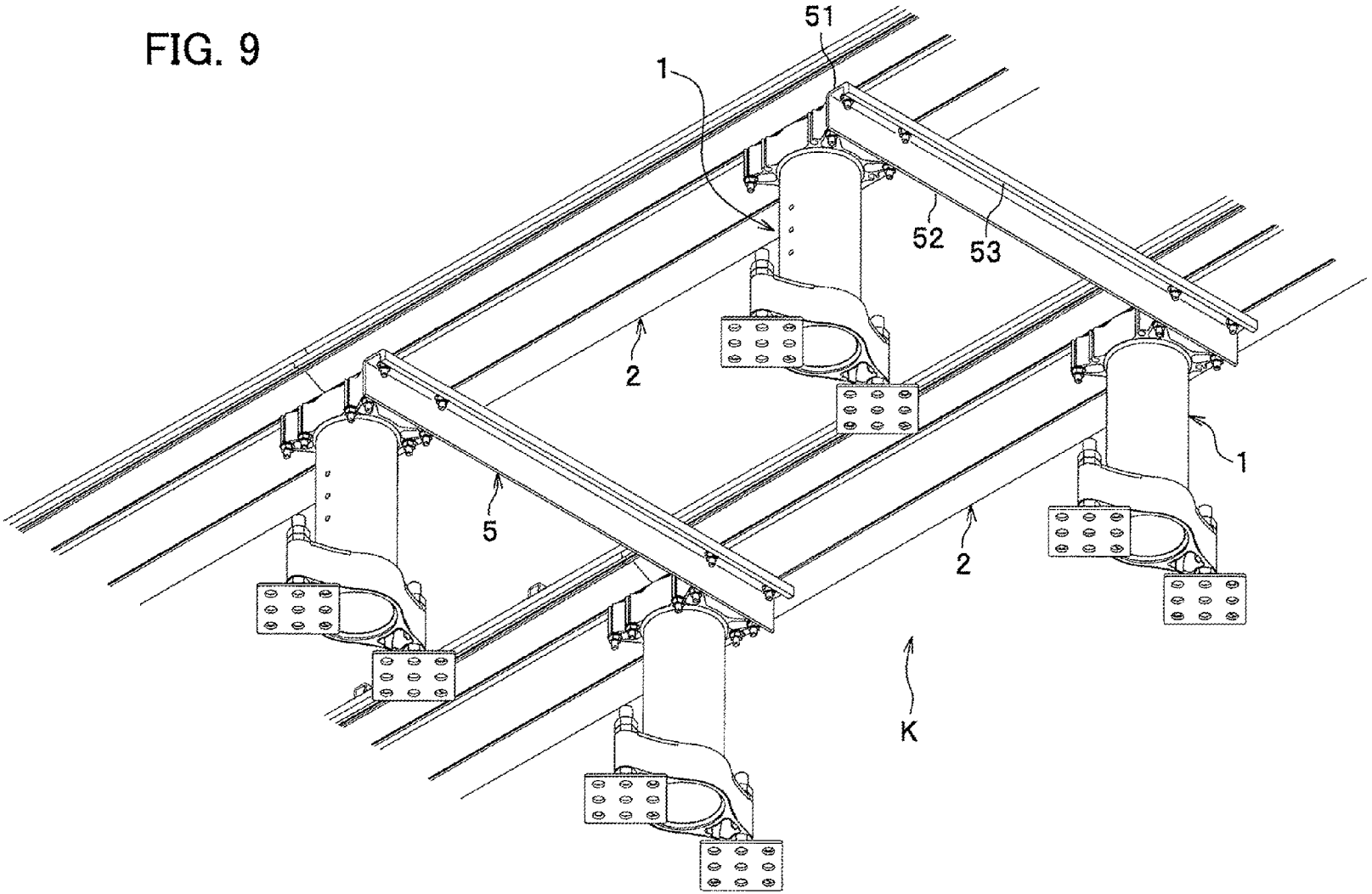
FIG. 9 is a perspective view, from the lower side, of the double floor structure according to the embodiment of the present invention.

Next, the structures of the connection members 5 are explained in detail. FIG. 9 is a perspective view, from the lower side, of the double floor structure K according to the present embodiment.

As illustrated in FIG. 9, the connection members 5 are arranged in the direction perpendicular to the length direction of the beams 2, and fixed to the lower surfaces of the beams 2 on the left and right sides. Each of the connection members 5 includes an abutting portion 51 and side walls 52 and 53. The abutting portion 51 abuts the lower surfaces of the beams 2. The side walls 52 and 53 extend downward from both side edges of the abutting portion 51. As illustrated in FIG. 6, a pair of through holes 5*a* spaced by the distance between the adjacent latching grooves 2*a* in each beam 2 are formed at each end portion of the connection member 5. The shanks of connection bolts B4 are inserted through the through holes 5*a*.

The connection members 5 can be joined to the beams 2 by use of the connection bolts B4 and connection nuts N4. Specifically, the connection members 5 are joined to the lower surfaces of the beams 2 by inserting the heads of the connection bolts B4 into the latching grooves 2*a* from ends of the beams 2, inserting the shanks of the connection bolts B4 through the through holes 5*a*, screwing the shanks of the connection bolts B4 into the connection nuts N4 arranged on the lower side of the connection members 5, and tightening the screws. Although not shown, alternatively, the connection members 5 can be joined to the beams 2 by inserting the shanks of the connection bolts B4 through the through holes 5*a* from the lower side of the connection members 5, and screw engaging the shanks of the connection bolts B4 with the connection nuts N4 held in the latching grooves 2*a*.

Although the pieces of equipment C are installed on the double floor structures K, the covering panels P1 are arranged over the areas on which the pieces of equipment C are not installed, as illustrated in FIG. 1. The covering panels P1 are detachably arranged to cover the spaces between adjacent beams 2, and are removed when a piece of equipment C is additionally installed. As illustrated in FIG. 2, the covering panels P1 in the present embodiment are placed on projecting supports 21, which are formed on the side surfaces of the beams 2. Engagement members 22 which can engage with the covering panels P1 from the lower side are attached to the projecting supports 21. The engagement members 22 can prevent movement of the covering panels P1 in the front-rear direction (in the direction perpendicular to paper plane in FIG. 2).

The arrangement of the covering panels P1 can prevent dissipation of the conditioned air, which flows in the underfloor space for cooling the pieces of equipment C. Therefore, the arrangement of the covering panels P1 enables efficient cooling of the pieces of equipment C. Although the detachable arrangement of the covering panels P1 is realized in the present embodiment by placement of the covering panels P1 on the projecting supports 21 formed on the side surfaces of the beams 2, alternatively, the covering panels P1 may be fixed to the beams 2 by using a detachable fixing means (bolts, screws, and the like) or an detachable engagement mechanism.

Although the floor panels P2 are arranged to cover the passage areas F2 as illustrated in FIG. 1, the floor panels P2 include two types, a perforated type (having a number of through holes) and an unperforated type (having no holes). It is possible to appropriately select the perforated type or the unperforated type according to the heat generation rates of the pieces of equipment C, the air flows in the room, and other conditions.

According to the double floor structure K having the above structure, the rigidity of the upper members 14 can be varied by changing the cut length in the primary extruded shape 14' (from which the upper members 14 are cut). Therefore, the maximum load or the earthquake resistance of the double floor structure K can be easily controlled. That is, the maximum load or the earthquake resistance of the double floor structure K can be adjusted without changing the cross-sectional profile of the primary extruded shape 14' (from which the upper members 14 are cut). In addition, the elevation of the underfloor space can be easily changed by simply changing the cut length in at least one of the primary extruded shape 12' (from which the lower member 12 are cut), the primary extruded shape 13' (from which the intermediate member 13 are cut), and the primary extruded shape 14' (from which the upper members 14 are cut). Further, the double floor structure K can cope with the execution conditions and customers' needs at low cost. Alternatively, the strengths of the support legs 1 (and therefore the max load and the earthquake resistance of the double floor structure K) can be adjusted by changing the cross-sectional profiles and/or thicknesses of the extruded shapes 12', 13', and 14'.

According to the support legs 1 in the present embodiment, the bottom portion of the intermediate member 13 is inserted into the lower member 12, and the top portion of the intermediate member 13 is inserted into the upper member 14. Therefore, the intermediate member 13 can be easily positioned when the intermediate member 13 is fixed to the lower member 12 or to the upper member 14.

In the support legs 1, the lower member 12 and the intermediate member 13 are joined by welding, instead of bolt connection, and the intermediate member 13 and the lower member 12 are also joined by welding, instead of bolt connection. Therefore, it is possible to simplify the operations for assembling the support legs 1 (since drilling, screwing of bolts, and the like are unnecessary).

The support legs 1 are formed by using the hollow members. Therefore, the flow of the conditioned air in the underfloor space for cooling the pieces of equipment C becomes smooth, so that the pieces of equipment C can be efficiently cooled.

In the double floor structure K according to the present embodiment, the support legs 1 are fixed to the beams 2 by using the latching grooves 2*a* formed in the beams 2. The use of the latching grooves 2*a* enables fixing of the support legs 1 at arbitrary positions in the length direction of the beams 2, easy increase or decrease in the intervals at which the support legs 1 are arranged, and easy adjustment of the maximum load and the earthquake resistance of the double floor structure K.

In the double floor structure K, the support legs 1 supporting one of two adjacent beams 2 and the support legs 1 supporting the other of the two adjacent beams 2 are connected through the two adjacent beams 2 and the connection members 5. Therefore, it is possible to achieve high rigidity of the double floor structure K.

In the double floor structure K, the connection members 5 are fixed to the beams 2 by using the latching grooves 2*a*. Therefore, the positions at which the connection members 5 are fixed can be arbitrarily changed along the length direction of the beams 2, and the number of the connection members 5 can be easily increased.

Figure 10:
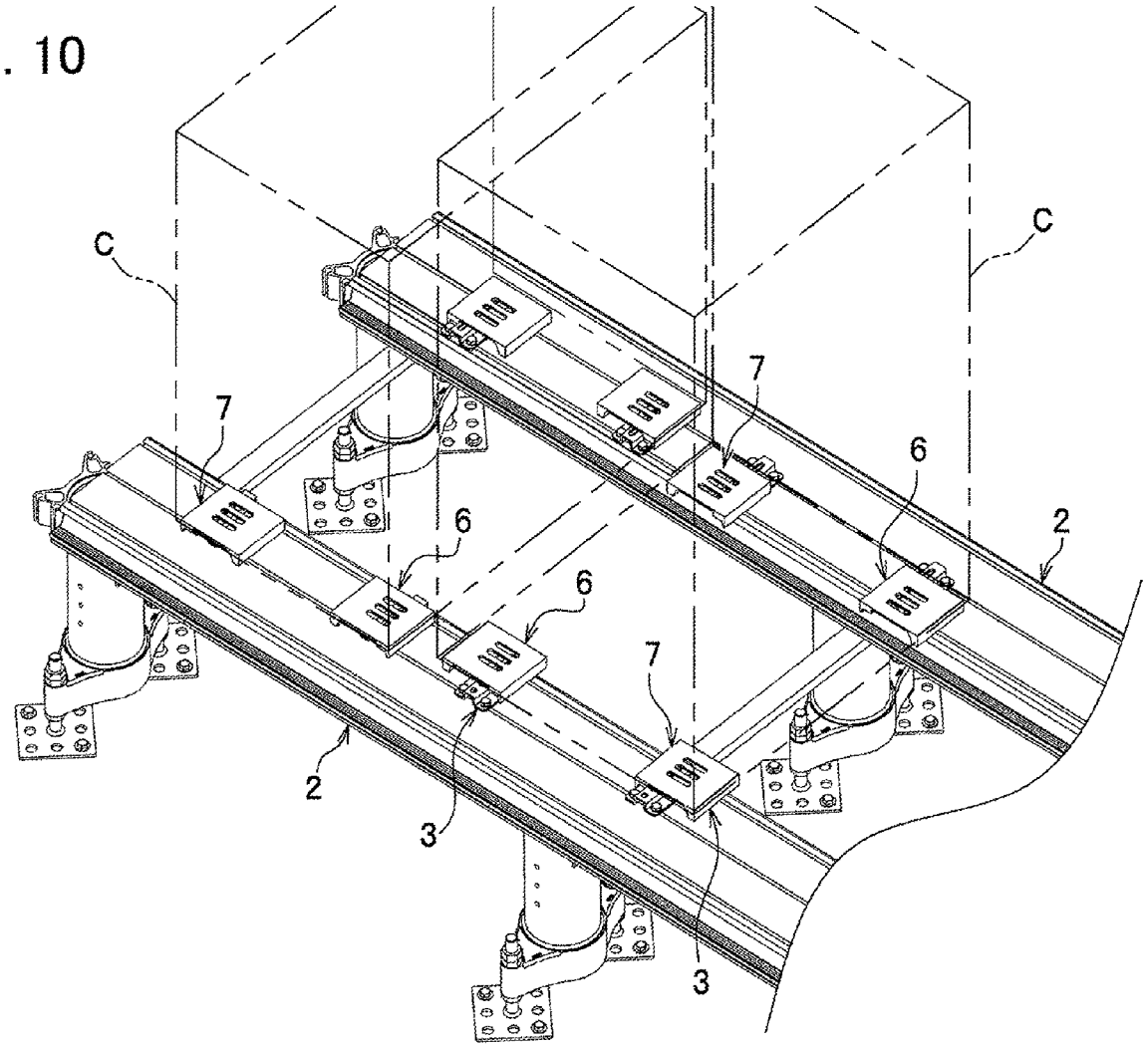
FIG. 10 is a perspective view illustrating a variation of the double floor structure according to the embodiment of the present invention.

Although the pieces of equipment C are placed on the first and second seat members 3 and 4 in the present embodiment, it is possible to arrange supplementary members 6 and 7 between the pieces of equipment C and the beams 2 as illustrated in FIG. 10. In the case where the supplementary members 6 and 7 are arranged and the pieces of equipment C are placed on the supplementary members 6 and 7, it is possible to support the pieces of equipment C more stably. Since the supplementary members 6 are arranged plane symmetric (mirror symmetric) to the supplementary members 7, the following explanations are focused on the supplementary members 6.

Figure 11A:
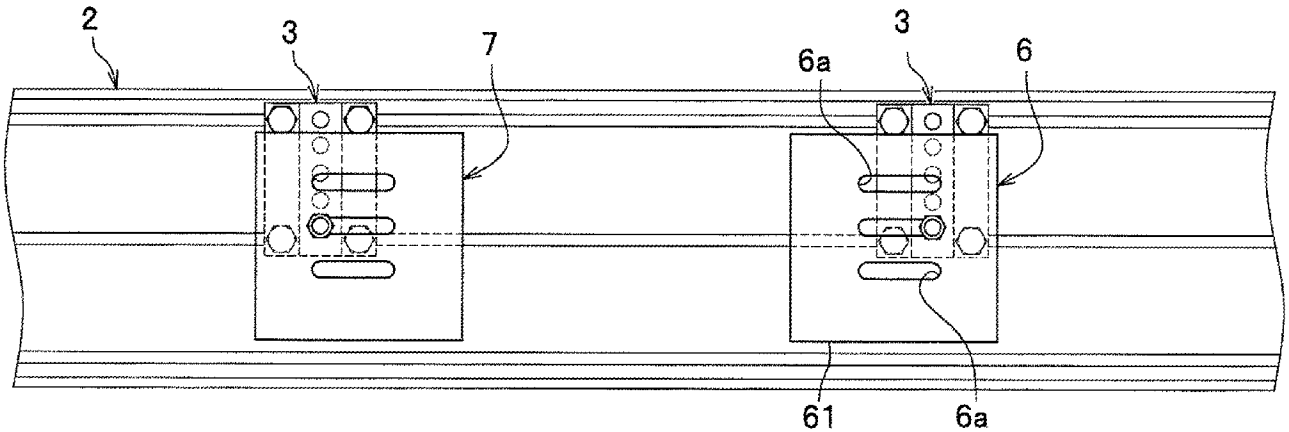
FIG. 11A is a side view of the variation of the double floor structure.
Figure 11B:
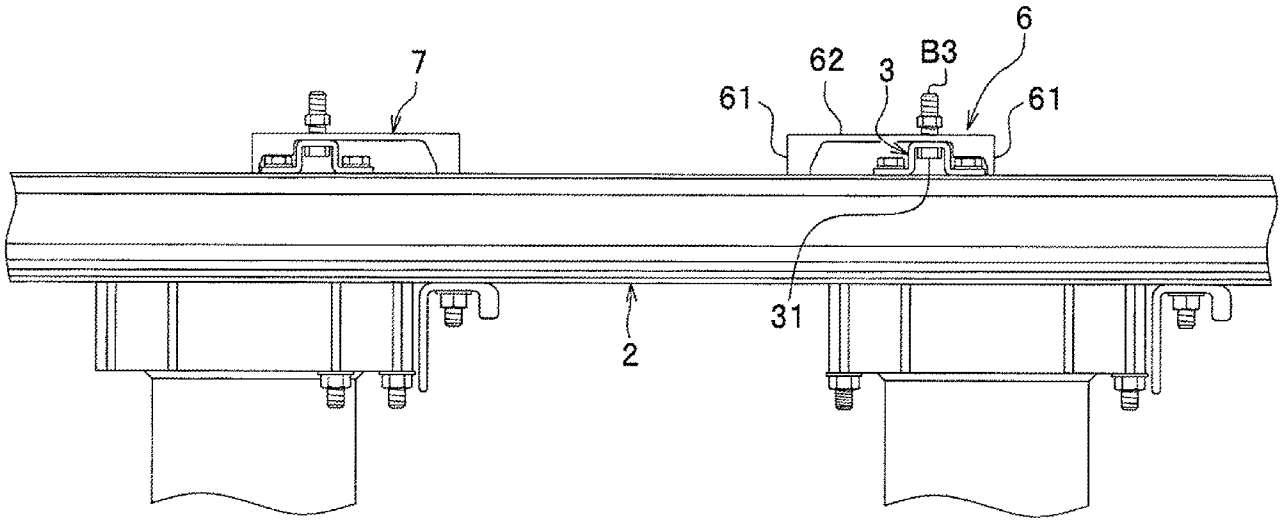
FIG. 11B is a top view of the variation of the double floor structure.

The supplementary members 6 transfer the weights of the pieces of equipment C to the beams 2 (as illustrated in FIG. 10). The supplementary members 6 are arranged to straddle the first seat members 3 (or the second seat members 4). The supplementary members 6 in the present embodiment are formed of an extruded shape of an aluminum alloy. As illustrated in FIG. 11B, each of the supplementary members 6 includes a pair of supports 61 and a table portion 62. The supports 61 are respectively arranged on the front and rear sides.

The supports 61 are arranged on the front and rear sides of the first seat members 3 so as to project from the lower surface of the table portion 62. The supports 61 is arranged to have the same height as the first seat members 3.

The upper surface of the table portion 62 abuts the lower surface of one of the pieces of equipment C (illustrated in FIG. 10), and the lower surface of the table portion 62 abuts the upper surface of the bolt holder 31 in the first seat members 3. As illustrated in FIG. 11A, the table portion 62 has a planar shape. A plurality of elongated adjustment holes 6*a* being arrayed in the lateral direction of the beams 2 are formed in the table portion 62. The shank of the equipment-fixing bolt B3 can be inserted through the elongated adjustment holes 6*a*. It is possible to appropriately select one of the elongated adjustment holes 6*a* through which the equipment-fixing bolt B3 is to be inserted, according to the depth of the piece of equipment C (or the dimension of the beams 2 in the lateral direction). Since the elongated adjustment holes 6*a* are elongated in the direction along the length direction of the beams 2, it is possible to adjust the position of the insertion of the equipment-fixing bolt B3 according to the width of the piece of equipment C (or the dimension of the beams 2 in the length direction).

Figure 12B:
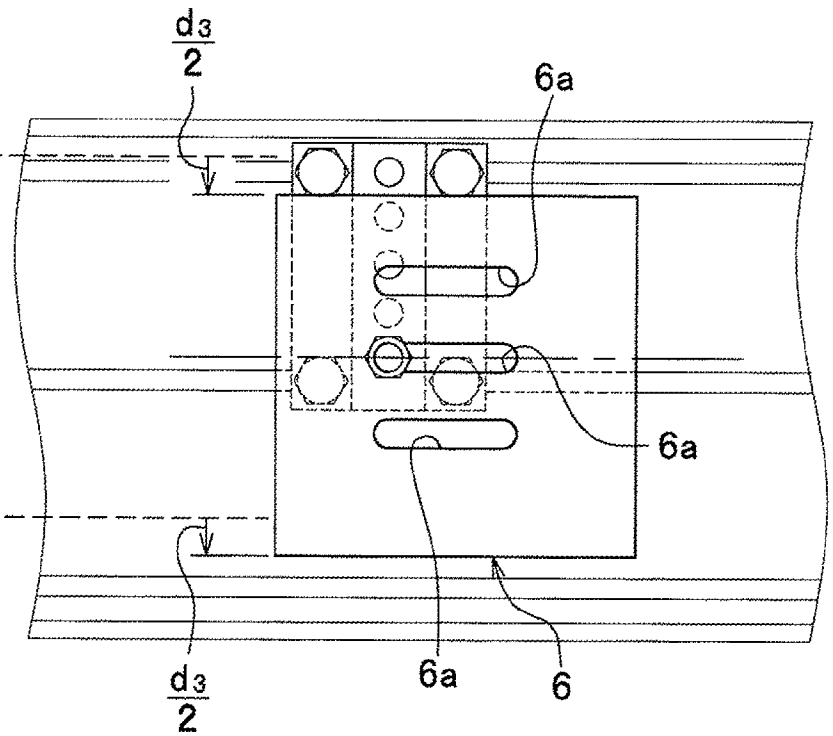
FIG. 12B is a top view illustrating a situation in which the supplementary member is turned around.
Figure 12A:
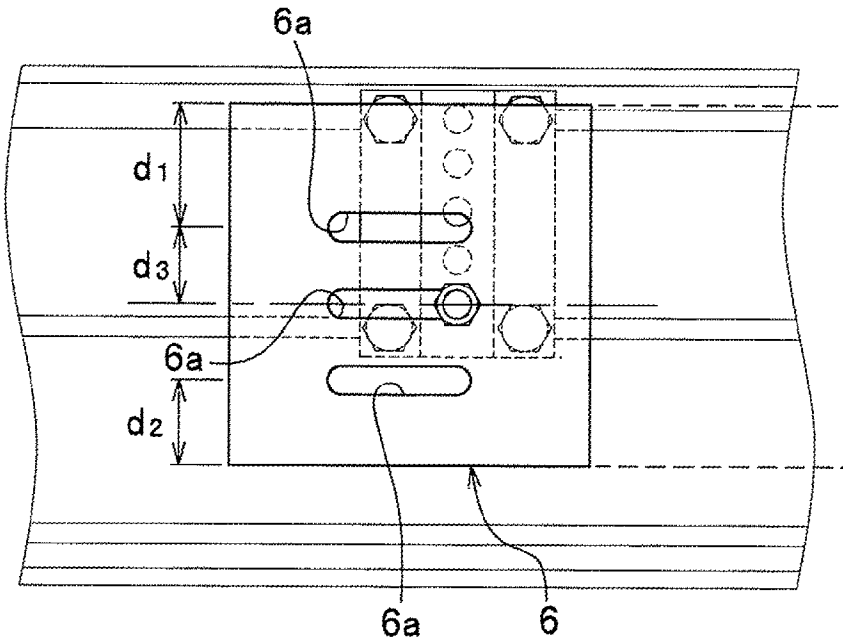
FIG. 12A is a top view of a supplementary member.

As illustrated in FIGS. 12(*a*) and 12(*b*), the plurality of elongated adjustment holes 6*a* are asymmetrically arranged in the lateral (left-right) direction. That is, the positions of the elongated adjustment holes 6*a* are set in such a manner that the arrangement of the elongated adjustment holes 6*a* after the supplementary members 6 (illustrated in FIG. 12B) is turned 180 degrees around in the horizontal plane is different from the arrangement of the elongated adjustment holes 6*a* before the supplementary members 6 (illustrated in FIG. 12A) is turned 180 degrees around in the horizontal plane. In the present embodiment, the supplementary members 6 are arranged so that the distance $d_1$ between a side edge of each of the supplementary members 6 and the center line of one of the elongated adjustment holes 6*a* located at an end the array of the elongated adjustment holes 6*a* is greater than the distance $d_2$ between the opposite side edge of the supplementary member 6 and the center line of one of the elongated adjustment holes 6*a* located at the other end the array of the elongated adjustment holes 6*a*. The difference ($d_1$-$d_2$) between the distance $d_1$ and the distance $d_2$ is equal to half of the distance $d_3$ between the centers of the adjacent ones of the elongated adjustment holes 6*a*. When each of the supplementary members 6 having the above arrangement of the elongated adjustment holes 6*a* is turned 180 degrees around in the horizontal plane, the positions of the opposite ends of the supplementary member 6 are shifted by the difference ($d_1$-$d_2$) between the distance $d_1$ and the distance $d_2$ (which is equal to $d_3/2$). Therefore, it is possible to finely adjust the positions of the supplementary members 6 according to the shape and the like of each piece of equipment C.

REFERENCE SIGNS LIST

K: double floor structure
1: support legs (support legs for double floor)
11: legs
12: lower member
13: intermediate member
14: upper member
2: beams (member constituting upper floor)
2*a*: latching grooves
2*b*: seat-fixing grooves
3, 4: seat members
3*a*: equipment-fixing holes
4*a*, 4*b*: elongated holes
5: connection members
P1: covering panels

The invention claimed is:

1. A double floor structure comprising:

a plurality of support legs to be placed on a lower floor; and a plurality of beams which are arranged in a plurality of rows and constitute an upper floor;

wherein each of the support legs includes an upper member supporting the plurality of beams from a lower side, a lower member arranged below the upper member, and an intermediate member arranged between the upper member and the lower member, and each of the upper member, the intermediate member, and the lower member is formed of a metal extruded shape, and is to be positioned in such a manner that an extrusion direction coincides with a vertical direction, the upper member including a bottom surface that faces the lower member and a top surface that is opposite the bottom surface, the upper member defining a hollow with an inner diameter that extends from the bottom surface to the top surface so as to receive the intermediate member.

2. The double floor structure according to claim 1, wherein an upper portion of the intermediate member is inserted into the upper member, and a lower portion of the intermediate member is inserted into the lower member.

3. The double floor structure according to claim 2, wherein one or more latching grooves extending in length directions of the plurality of beams are formed on lower surfaces of the plurality of beams, and the upper member is fixed to the plurality of beams by screw engaging one or more shanks of one or more bolts inserted through the upper member with one or more nuts held in the one or more latching grooves, or by screw engaging one or more shanks of one or more bolts having one or more heads held in the one or more latching grooves with one or more nuts arranged on a lower side of the upper member.

4. The double floor structure according to claim 3, further comprising one or more connection members which connect adjacent ones of the plurality of beams, and the one or more connection members are fixed to the adjacent ones of the plurality of beams by screw engaging shanks of bolts inserted through the one or more connection members with nuts held in the one or more latching grooves, or by screw engaging shanks of bolts having heads held in the one or more latching grooves with nuts arranged on one or more lower sides of the one or more connection members.

5. A double floor structure comprising:

a plurality of support legs to be placed on a lower floor;

a plurality of beams which are arranged in a plurality of rows under equipment; and a plurality of seat members which realize seats for the equipment;

wherein each of the support legs includes an upper member supporting the plurality of beams from a lower side, a lower member arranged below the upper member, and an intermediate member arranged between the upper member and the lower member;

each of the upper member, the intermediate member, and the lower member is formed of a metal extruded shape, and is to be positioned in such a manner that an extrusion direction coincides with a vertical direction;

a plurality of seat-attachment grooves extending in length directions of the plurality of beams are formed on upper surfaces of the plurality of beams;

the plurality of seat members are fixed to the plurality of beams by using at least two of the plurality of seat-attachment grooves;

the plurality of seat members each include a bolt holder which holds a head of an equipment-fixing bolt for fixing the equipment to the seats; and a plurality of equipment-fixing holes are formed on an upper wall of the bolt holder, where a shank of the equipment-fixing bolt can be inserted through any of the plurality of equipment-fixing holes, and the plurality of equipment-fixing holes are formed in such positions that an arrangement of the plurality of equipment-fixing holes when the bolt holder is turned around to an opposite direction in a horizontal plane is different from an arrangement of the plurality of equipment-fixing holes before the bolt holder is turned around.

6. The double floor structure according to claim 5, further comprising supplementary members which transfer weight of the equipment to the plurality of beams, and the supplementary members are arranged to respectively straddle the plurality of seat members.

7. The double floor structure according to claim 5, further comprising a covering panel in an area on which no equipment is placed, and the covering panel is detachably arranged between adjacent ones of the plurality of beams.

8. A double floor structure comprising:

a plurality of support legs to be placed on a lower floor;

a plurality of beams which are arranged in a plurality of rows under equipment; and a plurality of seat members which realize seats for the equipment;

wherein each of the support legs includes an upper member supporting the plurality of beams from a lower side, a lower member arranged below the upper member, and an intermediate member arranged between the upper member and the lower member;

each of the upper member, the intermediate member, and the lower member is formed of a metal extruded shape, and is to be positioned in such a manner that an extrusion direction coincides with a vertical direction;

a plurality of seat-attachment grooves extending in length directions of the plurality of beams are formed on upper surfaces of the plurality of beams;

the plurality of seat members are fixed to the plurality of beams by using at least two of the plurality of seat-attachment grooves;

the plurality of seat members each include a bolt holder which holds a head of an equipment-fixing bolt for fixing the equipment to the seats; and a longer elongated hole and a shorter elongated hole are formed on an upper wall of the bolt holder, where a shank of the equipment-fixing bolt can be inserted through either of the longer elongated hole and the shorter elongated hole.

9. The double floor structure according to claim 8, further comprising supplementary members which transfer weight of the equipment to the plurality of beams, and the supplementary members are arranged to respectively straddle the plurality of seat members.

10. The double floor structure according to claim 8, further comprising a covering panel in an area on which no equipment is placed, and the covering panel is detachably arranged between adjacent ones of the plurality of beams.

11. A support leg to be placed on a lower floor for construction of a double floor structure, comprising:

an upper member which supports from a lower side of an upper floor structure constituting an upper floor;

a lower member arranged below the upper member; and an intermediate member arranged between the upper member and the lower member;

each of the upper member, the intermediate member, and the lower member is formed of a metal extruded shape, and is to be positioned in such a manner that an extrusion direction coincides with a vertical direction, the upper member including a bottom surface that faces the lower member and a top surface that is opposite the bottom surface, the upper member defining a hollow with an inner diameter that extends from the bottom surface to the top surface so as to receive the intermediate member.

12. The support leg according to claim 1, wherein the intermediate member has a cylindrical shape.

13. The support leg according to claim 12, wherein a female screw is formed in a side wall of the intermediate member.

14. The support leg according to claim 11, wherein the upper member and the intermediate member are joined by welding, and the intermediate member and the lower member are joined by welding.

15. The support leg according to claim 14, wherein a female screw is formed in a side wall of the intermediate member.

* * * * *